United States Patent [19]

Kimpara et al.

[11] Patent Number: 4,924,745

[45] Date of Patent: May 15, 1990

[54] AUTOMATIC PERFORMANCE RECORDING APPARATUS

[75] Inventors: Mamoru Kimpara; Tetsuji Ichiki, both of Hamamatsu, Japan

[73] Assignee: Yamaha Corporation, Hamamatsu, Japan

[21] Appl. No.: 297,610

[22] Filed: Jan. 13, 1989

[30] Foreign Application Priority Data

Jan. 14, 1988 [JP] Japan ..... 63-4987
Jan. 14, 1988 [JP] Japan ..... 63-4988
Jan. 14, 1988 [JP] Japan ..... 63-4989

[51] Int. Cl.[5] ..... G10H 1/36; G10H 7/00
[52] U.S. Cl. ..... 84/609; 84/649
[58] Field of Search ..... 84/1.03, 1.28, DIG. 12, 84/DIG. 22, 609-614, 649-652

[56] References Cited

FOREIGN PATENT DOCUMENTS 58-211191 12/1983 Japan .

*Primary Examiner*—Stanley J. Witkowski

*Attorney, Agent, or Firm*—Spensley Horn Jubas & Lubitz

[57] ABSTRACT

An automatic performance recording apparatus for storing performance data for an automatic performance in a performance data memory means such as a RAM is disclosed. In order to allow easy and appropriate recording and correction of performance data, according to this invention, a specific recording mode for starting recording in synchronism with generation of first key-on data indicating generation of a musical tone is set. The specific recording modes include a synchronous recording mode in which a recording operation of performance data is suspended in an operation stop state, and is started simultaneously with generation of the key-on data, a re-recording mode in which a recording operation of performance data is suspended in the operation stop state, and is restarted from the beginning of a previously recorded section simultaneously with generation of the key-on data, and a running recording mode in which a recording operation of performance data is suspended in a playback state, and is started simultaneously with generation of the key-on data.

4 Claims, 13 Drawing Sheets

| | | |
|---|---|---|
| TIMING DATA | MARK | TIME DATA (TIMD) |
| KEY-ON DATA | MARK | KEY CODE (KC) |
| KEY-OFF DATA | MARK | KEY CODE (KC) |
| TONE COLOR ETC. DATA | MARK | TONE COLOR / EFFECT NAME DATA |
| MEASURE CODE | MARK | MEASURE CODE |
| END CODE | END CODE | |

AUTOMATIC PERFORMANCE RECORDING APPARATUS

BACKGROUND OF THE INVENTION

1. Field of the Invention

The present invention relates to an automatic performance recording apparatus for recording performance data for controlling generation of musical tones in an electronic musical instrument or the like and, more particularly, to an automatic performance recording apparatus which sets a specific recording mode starting in synchronism with generation of key-on data indicating a musical tone to be recorded, so that recording and correction of performance data can be facilitated and can be optimally executed.

In this invention, three novel recording modes, i.e., a synchronous recording mode in which a performance data recording operation is started in synchronism with start of a music piece to be recorded, a re-recording mode for repetitively recording performance data in a given section of a performance data memory, and a running recording mode in which the recording operation is started in synchronism with already recorded performance data are disclosed as the specific recording mode.

2. Description of the Prior Art

As a conventional automatic performance apparatus of an electronic musical instrument, an apparatus which has a performance data memory, generates and records key data representing depressed key key-event timing data representing a key-on or key-off timing of each key based on the performance at a keyboard, and reads out the key data in accordance with a predetermined tempo and the timing data to play back original musical tones is known (Japanese Patent Laid-Open (Kokai) No. 58-211191).

The conventional automatic performance apparatus is arranged to immediately start a recording operation when a recording mode is set. It is difficult to synchronize setting of the recording mode and the start of a performance (key-on). For this reason, when a performance is started after the recording mode is set, the start portion of performance data has a blank portion (non-performance state). When the recorded performance data is played back, no tone can be generated at a moment of the beginning of the playback operation, and a player feels uneasy. The non-performance portion recorded in the performance data memory wastes the memory space.

In the conventional automatic performance apparatus, when previously recorded performance data is corrected or added, the performance data must be re-recorded from the beginning or must be played back to detect the beginning of a section to be corrected or added and the recording mode is then set to re-record the performance data in this section. With this operation, it is difficult to set the start timing of recording, and it is also difficult to synchronize the start portion.

SUMMARY OF THE INVENTION

The present invention has been made in consideration of the conventional problems, and has as its first object to provide an automatic performance recording apparatus which records performance data for controlling generation of musical tones along with the progress of a music piece in real time, and which can start a recording operation in synchronism with the start of performance of the music piece.

It is a second object of the present invention to provide an automatic performance recording apparatus which can easily correct already recorded performance data in an arbitrary section.

It is a third object of the present invention to provide an automatic performance recording apparatus which can restart recording from a recording start point of previously recorded performance data, and can achieve a real-time edit operation of performance data in a section starting from the recording restart point.

An automatic performance apparatus according to the present invention comprises: performance data memory means for storing performance data for controlling generation of musical tones along with the progress of a music piece; performance data recording means for recording performance data sequentially generated along with the progress of the music piece in the performance data memory means; specific recording mode selection means for selecting a specific recording mode; and operation mode control means for, when the specific recording mode is selected by the mode selection means, setting an operation mode of the performance data recording means in a recording preparation mode, and for, when key-on data indicating generation of a musical tone to be recorded as the performance data is generated, switching the operation mode to the recording mode.

According to the present invention, as the specific recording mode for achieving the first object, a synchronous recording mode is prepared wherein recording of performance data is suspended in an operation stop state, and is started simultaneously with generation of the key-on data. As the specific recording mode for achieving the second object, a re-recording mode is prepared wherein recording of performance data is suspended in an operation stop state, and re-recording is started from the beginning of a previously recorded section simultaneously with generation of the key-on data. As the specific recording mode for achieving the third object, a running recording mode is prepared wherein recording of performance data is suspended in a playback mode, and is started simultaneously with generation of the key-on data.

FIG. 1A is a functional block diagram of an automatic performance apparatus for realizing the synchronous recording mode. The automatic performance apparatus shown in FIG. 1A comprises a performance data memory means 1 for recording performance data for controlling generation of a musical tone along with progress of a music piece, a performance data recording means 2 for recording performance data sequentially input along with the progress of the music piece in the performance data memory 1, a recording mode selection means **3*a* for selecting a synchronous recording mode as the specific recording mode, and an operation mode control means 4*a* for, when the synchronous recording mode is selected by the mode selection means 3*a*, setting an operation mode of the performance data recording means 2** in a recording standby (recording preparation) mode and for, when key-on data indicating generation of a first musical tone is generated, switching the operation mode to the recording mode.

In the arrangement of FIG. 1A, when a music piece is to be started in synchronism with the start of recording, a player selects the synchronous recording mode by the synchronous recording mode selection means **3*a*, e.g., a switch, and then starts a performance. In the automatic performance recording apparatus of this invention, upon operation of the synchronous recording mode selection means 3a, the operation mode control means 4a sets the performance data recording means 2 in the recording preparation mode. The performance data recording means 2 is suspended after it prepares for the start of recording, e.g., addresses a start storage position of the performance data memory means 1, e.g., a RAM, sets time base data to be an initial value, and the like. In this state, when key-on data indicating generation of a first musical tone is generated upon start of the performance of the music piece, the operation mode control means 4a switches the performance data recording means 2 to the recording mode, and the performance data recording means 2** starts recording of performance data.

As can be understood from the above description, according to the arrangement shown in FIG. 1A, recording of performance data can be easily started in synchronism with the start of the performance of the music piece, and formation of a blank portion at the beginning of recording can be prevented. Thus, a player can be free from an uneasy feeling, and a memory capacity can be saved.

FIG. 1B is a functional block diagram for realizing the re-recording mode. The automatic performance recording/playback apparatus shown in FIG. 1B comprises the performance data memory means 1 for recording performance data for controlling generation of a musical tone along with progress of a music piece, the performance data recording means 2 for recording performance data sequentially input along with the progress of the music piece in the performance data memory 1, a re-recording mode selection means 3b, a recording position storage means 5 for storing a performance data recording position when the performance data recording means 2 starts a recording operation, and an operation mode control means 4b for, when the re-recording mode is selected by the re-recording mode selection means 3b, setting the performance data recording position at a position stored in the storage means 5 to set a recording standby state and for, when key-on data indicating generation of a first musical tone is generated, switching the operation mode to the recording mode.

In the arrangement shown in FIG. 1B, when performance data is to be corrected or added during recording, a player selects the re-recording mode by the re-recording mode selection means 3b, e.g., a switch, and then starts a performance. In the automatic performance recording/playback apparatus of this invention, upon operation of the re-recording mode selection means 3b, the operation mode control means 4b changes a performance data storage position recorded by the performance data recording means 2 to a position, e.g., a previous recording start position stored in the recording position storage means 5, and sets the operation mode of the recording means 2 in the recording standby mode. In this recording standby state, when key-on data indicating generation of a first musical tone is generated upon start of a performance of the music piece, the operation mode control means 4b switches the operation mode of the performance data recording means 2 to the recording mode in synchronism with the key-on event.

As can be understood from the above description, according to the arrangement shown in FIG. 1B, performance data can be repetitively recorded (over-dubbed) in a given section, and performance data can be easily corrected in small pieces until a player is satisfied with correction results.

FIG. 1C is a block diagram showing an automatic performance apparatus for realizing the running recording mode. The automatic performance recording/playback apparatus shown in FIG. 1C comprises the performance data memory means 1 for recording performance data for controlling generation of a musical tone along with progress of a music piece, the performance data recording means 2 for recording performance data sequentially input along with the progress of the music piece in the performance data memory 1, a running recording mode selection means 3c, and an operation mode control means 4c for, when the running recording mode is selected by the running recording mode selection means, setting a recording reservation mode while maintaining a playback operation state, and for, when key-on data indicating generation of a first musical tone is generated, continuously switching and setting the operation mode to the recording mode without changing an address in the playback operation state.

In the arrangement shown in FIG. 1C, when already recorded performance data is to be corrected or added, a player selects the running recording mode by the running recording mode selection means 3c, e.g., a switch, and then starts a performance at the beginning of a section to be corrected or added or immediately therebefore at an appropriate pause while listening to automatic performance tones. In the automatic performance recording/playback apparatus of the present invention, upon operation of the running recording mode selection means 3c, the operation mode control means 4c sets the performance data recording means 2 in the recording reservation mode while maintaining the playback state. In this state, when key-on data indicating generation of a first musical tone is generated upon start of a performance of a music piece, the operation mode control means 4c switches the operation mode of the performance data recording means 2 to the recording mode to be continued such that a performance timing and a performance data storage position (address) are continued from the playback state. Thus, the automatic performance recording/playback apparatus of the present invention can continuously shift from the playback state to the recording state.

As can be seen from the above description, according to the present invention, a recording operation can be restarted in response to a key-on event at an arbitrary timing in a playback state. More specifically, data can be over-dubbed (over-written) at an arbitrary timing. For example, when performance data is partially failed to input, the corresponding portion can be very smoothly edited in real time without shifting a timing.

DETAILED DESCRIPTION OF THE PREFERRED EMBODIMENT

Figure 1A:
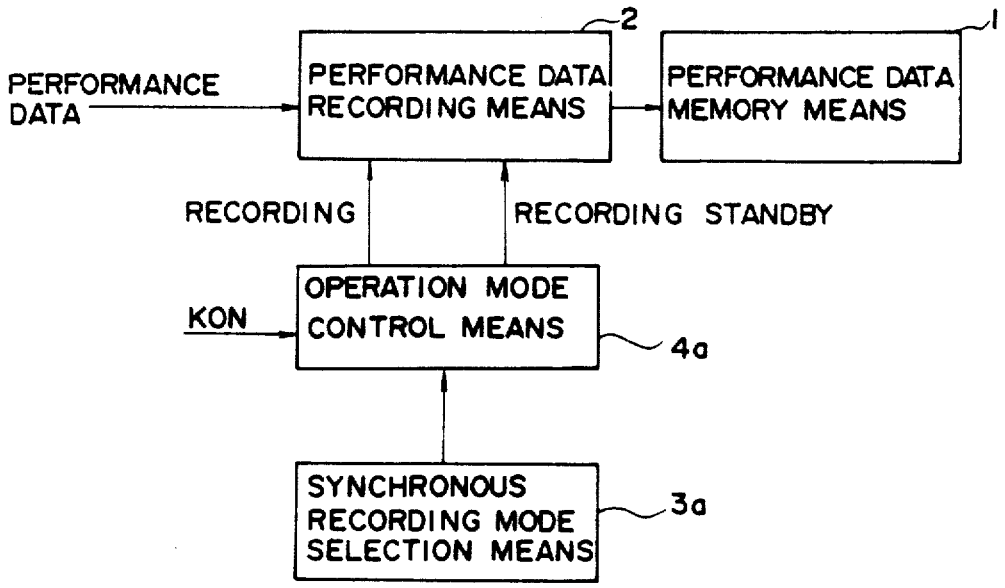
FIGS. 1A to 1C are functional block diagrams of automatic performance recording/playback apparatuses for respectively realizing a synchronous recording mode, a re-recording mode, and a running recording mode according to the present invention.
Figure 1B:
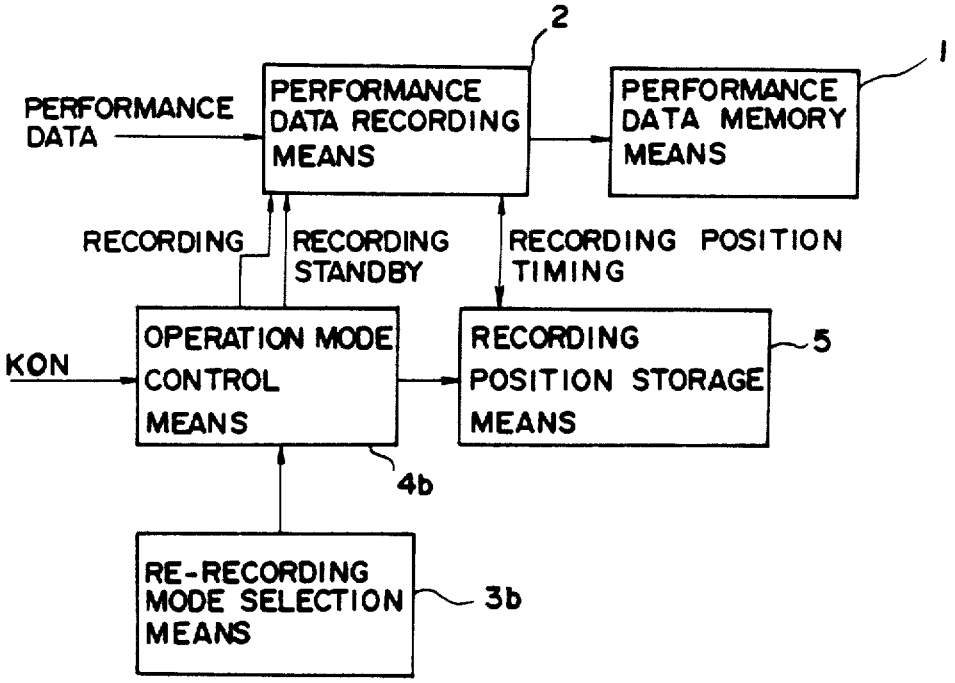
Figure 1C:
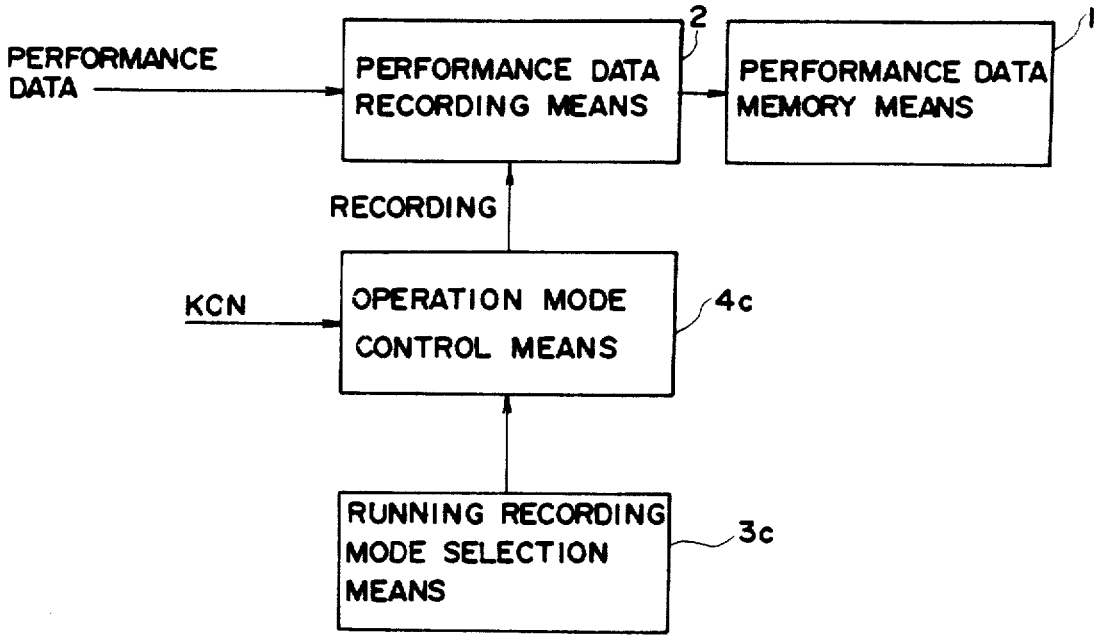
Figure 2:
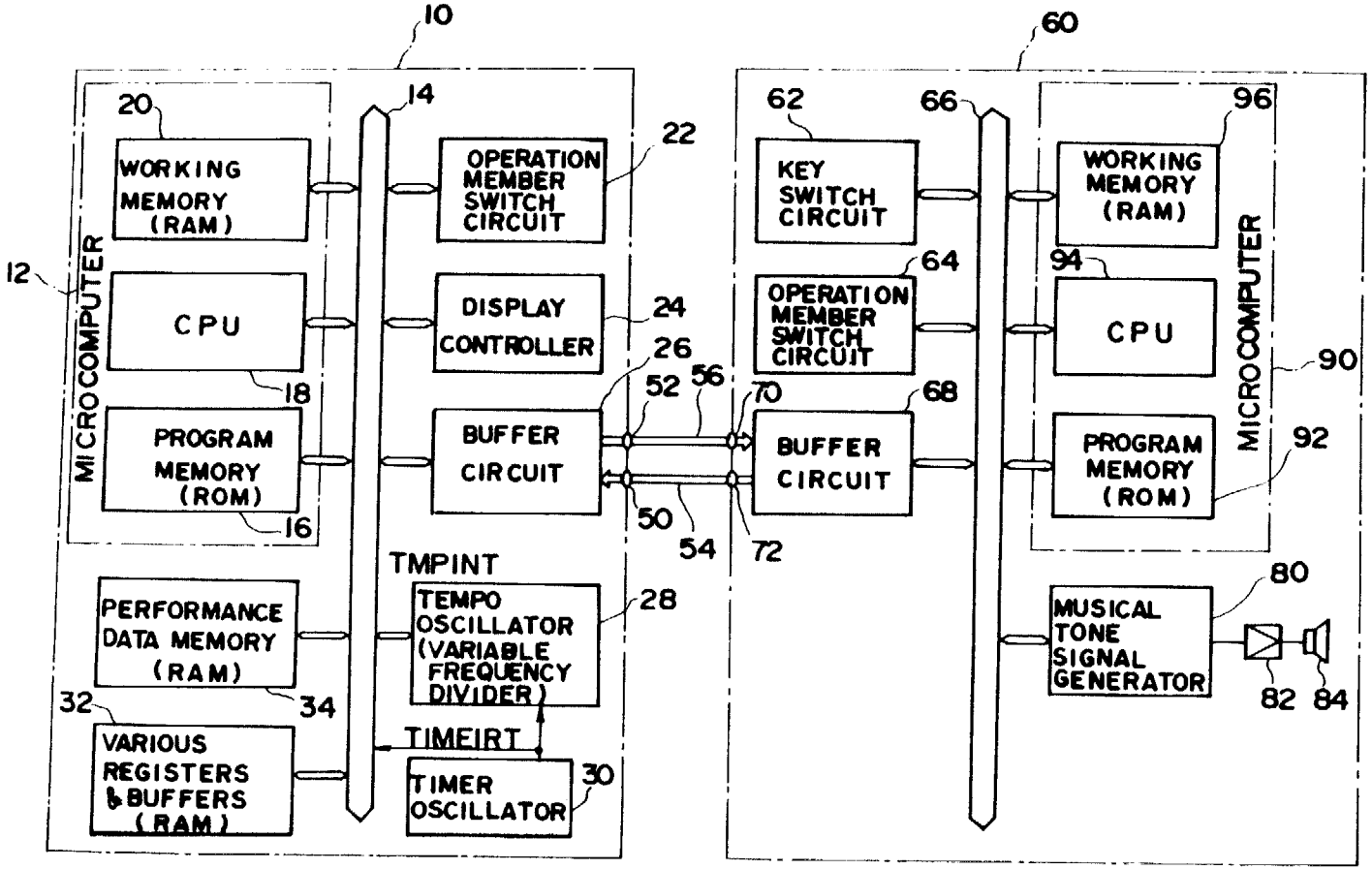
FIG. 2 is a block diagram of an automatic performance system comprising an automatic performance recording/playback apparatus according to an embodiment of the present invention.

An embodiment of the present invention will now be described with reference to the accompanying drawings. FIG. 2 is a block diagram of an automatic performance system to which an automatic performance recording/playback apparatus according to an embodiment of the present invention is applied. An automatic performance recording/playback apparatus 10 is a so-called MIDI recorder, which complies with the MIDI (Musical Instrument Digital Interface) standards, and can exchange performance data with another apparatus complying with the MIDI standards. In this embodiment, the MIDI recorder 10 is connected to an electronic musical instrument 60 complying with the MIDI standards and comprising both a keyboard as an input device and a sound source as an output device (musical tone forming circuit), thus constituting an automatic performance system.

(Description of Arrangement of Recorder in FIG. 2)

The MIDI recorder 10 shown in FIG. 2 is arranged to control the entire operation using a microcomputer 12. The microcomputer 12 comprises a program memory 16, a CPU 18, and a working memory 20, which are connected to a bus 14. The bus 14 is connected to an operation member switch circuit 22, a display controller 24, a buffer circuit 26, a tempo oscillator 28, a timer oscillator 30, various registers & buffers 32, and a performance data memory 34.

The program memory 16 comprises a ROM, and stores a main program, interrupt programs including timer and tempo interrupt programs, and their subprograms corresponding to the flow charts shown in FIGS. 5 to 14.

The CPU 18 starts execution of the main program upon power-on of a power switch 46 (FIG. 3), and repetitively executes the main program until the power switch 46 is turned off. When the CPU 18 receives an interrupt signal (TMPINT or TIMEIRT) from the tempo oscillator 28 or the timer oscillator 30, it interrupts execution of the main program and executes the tempo or timer interrupt program.

The working memory 20 comprises a RAM, and temporarily stores various data generated when the CPU executes the programs The following flags, registers, and the like are set in the working memory 20. Note that in the following description, registers and the like and their contents (data) are represented by the same labels.

in-recording flag REC

...REC is a flag representing an operation state of the recorder 10, and when it is "1", represents that performance data is being written in the performance data memory 34 (recording mode), and when it is "0", represents that the recording mode is not set.

recording pause flag RECPSE

...RECPSE represents an operation state of the recorder 10, and when it is "1", represents that a recording synchronous start state (recording standby mode) is set. In this state, when a key-on (KON) signal is generated, the operation state is switched to a recording state (recording mode).

in-play flag PLY

...PLY represents an operation state of the recorder 10, and when it is "1", represents that automatic performance data is being read out from the performance data memory 34 (playback mode), and when it is "0", represents that the playback mode is not set.

play pause flag PLYPSE

...PLYPSE represents an operation state of the recorder 10, and when it is "1", represents that a play synchronous start state (playback standby mode) is set. In this state, when a key-on (KON) signal is generated, the operation state is switched to a playback state (playback mode).

running recording flag RUNREC

...RUNREC represents an operation state of the recorder 10, and when it is "1", represents that a running recording mode (in-play recording standby mode) is set. In this mode, a recording operation is waited while playing back performance data, and when a key-on (KON) signal is generated, the recorder 10 is switched from the playback state to the recording state.

tempo counter TCNT

...TCNT is a counter/register which is incremented by "1" every time the tempo oscillator 28 generates a tempo interrupt signal TMPINT, and its count value represents a progression position in one measure of an automatic performance.

previous tempo counter TCNT(PR)

...TCNT(PR) is a counter/register for storing a tempo count TCNT value when a latest recording operation is started. When a key-on signal KON is generated in the recording synchronous start mode or running recording mode, the counter/register TCNT(PR) stores the timing.

address pointer ADR

...ADR is an address designation counter/register for the performance data memory 34.

previous address ADR(PR)

...ADR(PR) is a counter/register for storing an address value ADR when a latest recording operation is started. When a key-on signal KON is generated in the recording synchronous start mode or running recording mode, the counter/register ADR(PR) temporarily stores an address of the performance data memory 34 upon key-on.

rewind flag REW

...REW represents an operation state of the recorder 10, and when it is "1", represents that a rewind mode for repetitively decrementing the address value ADR for a relatively short period is set.

fast-forward flag FF

...FF represents an operation state of the recorder 10, and when it is "1", represents that a fast-forward mode for repetitively incrementing the address value ADR for a relatively short period is set.

Figures 3, 4:
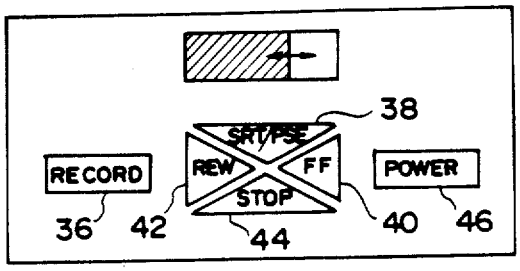
FIG. 3 is a view showing in detail a panel portion of a recorder in the system shown in FIG. 2.
FIG. 4 shows formats of various performance data stored in a performance data memory.

FIG. 3 shows the outer appearance of a panel portion of the recorder 10. The panel portion includes: a recording (RECORD) operation member 36 for setting an operation mode associated with a recording operation such as the recording mode, the recording synchronous start mode, the running recording mode, and the like; a start/pause (SRT/PSE) operation member 38 for starting the playback and recording operations, and for stopping (pausing) the playback, recording, fast-forward, and rewind operations without updating the previous tempo count value TCNT(PR) and the previous address value ADR(PR); fast-forward (FF) and rewind (REW) operation members 40 and 42 for incrementing and decrementing the address value ADR at a relatively high speed; a stop (STOP) operation member 44 for initializing the previous tempo count value TCNT(PR) and the previous address value ADR(PR) from the operation mode other than the fast-forward and rewind operations to set a stop mode; the power (POWER) switch 46; and a display 48. The operations at the mode setting operation members 36 to 44 are detected by a plurality of operation member switches arranged in the operation member switch circuit 22 shown in FIG. 2 in correspondence with the operation members, and the display 48 is controlled by the display controller 24.

The buffer circuit 26 is an interface for exchanging performance data with the electronic musical instrument 60 through data buses 54 and 60 connected to MIDI input and output terminals 50 and 52, respectively.

The tempo oscillator 28 comprises a frequency divider with a variable frequency division ratio. The oscillator 28 frequency-divides a clock pulse having a predetermined period output from the timer oscillator 30 in accordance with a preset tempo, and outputs a tempo interrupt signal TMPINT according to the tempo to the microcomputer 12 through the bus 14.

The timer oscillator 30 comprises a frequency-fixed oscillator. The oscillator 30 outputs an oscillation output at a predetermined frequency to the tempo oscillator 28, and also outputs it to the microcomputer 12 through the bus 14 as a timer interrupt signal TIMEIRT. The timer interrupt signal TIMEIRT is used for determining fast-forward and rewind speeds, i.e., a change rate of the address value ADR at that time.

The various registers & buffers 32 are used for temporarily storing various data generated when the microcomputer 12 executes the programs, and comprise a RAM. The various registers & buffers 32 include, e.g., an event buffer ITVBUF for temporarily storing performance data fetched by the microcomputer 12 from the buffer circuit 26.

The performance data memory 34 comprises a RAM, and has a large number of storage positions APM(ADR) addressed by the address value ADR set in an address register in the working memory 20. At the respective storage positions APM(ADR), the following automatic performance data are stored in data formats shown in FIG. 4. Upper 2 bits of data excluding an end code represent an identification mark indicating a type of data.

timing data

...timing data consists of an identification mark indicating the timing data, and time data TIMD representing a lapse of time from the beginning of a measure. As the time data TIMD, data corresponding to the tempo count value TCNT is written.

key-on data

...key-on data consists of an identification mark indicating key-on event data at a keyboard (not shown) of the electronic musical instrument 60, and a key code KC representing a depressed key.

key-off data

...key-off data consists of an identification mark indicating key-off event data at the keyboard, and a key code KC representing a released key.

tone color etc. data

...tone color etc. data consists of an identification mark representing tone color data or effect data updated by tone color operation members or effect operation members of the operation panel (not shown) of the electronic musical instrument 60, and tone color/effect name data representing the updated tone color or effect tone name.

measure code

...measure code indicates that the progression timing of an automatic performance is a timing corresponding to the beginning of a measure, its identification mark is equal to timing data, and time data is equal to timing data representing an end of a measure.

end code

...end code represents an end timing of an automatic performance.

(Description of Arrangement of Electronic Musical Instrument in FIG. 2)

The electronic musical instrument 60 shown in FIG. 2 comprises a key switch circuit 62 and an operation member switch circuit 64. The key switch circuit 62 has a plurality of key switches (not shown) arranged in correspondence with keys of a keyboard (not shown) for designating musical tones, and detects key-on events of the keys at the keyboard based on ON/OFF operations of the key switches.

The operation member switch circuit 64 comprises a plurality of operation member switches corresponding to tone color operation members and effect operation members, arranged on an operation panel (not shown), for designating tone colors and effects of musical tones, and detects the operations of the operation members on the operation panel based on the ON/OFF operations of the operation member switches. The key switch circuit 62 and the operation member switch circuit 64 are connected to a bus 66.

The bus 66 is connected to a buffer circuit 68, a musical tone signal generator 80, and a microcomputer 90. The buffer circuit 68 exchanges performance data with the recorder 10 through the data buses 56 and 54 respectively connected to MIDI input and output terminals 70 and 72. The musical tone signal generator 80 comprises a plurality of musical tone signal forming channels for forming musical tone signals corresponding to various musical instruments such as piano, violin, and the like. The generator 80 forms and outputs a musical tone signal based on information input from the microcomputer 90 through the bus 66 in accordance with information generated upon key-on or key-off events at the keyboard or upon operation of the tone color and effect operation members at the operation panel, and information which is read out from the performance data memory 34 in the recorder 10 and is input through the buffer circuits 26 and 68 and the data bus 56. The musical tone signal is supplied to an amplifier 82. The output of the amplifier 82 is connected to a loudspeaker 84. The loudspeaker 84 produces a musical tone corresponding to the musical tone signal supplied from the amplifier 82.

The microcomputer 90 comprises a program memory 92, a CPU 94, and a working memory 96, which are connected to the bus 66. The program memory 66 comprises a ROM, and stores a program corresponding to the flow chart shown in FIG. 15. The CPU 94 starts execution of the program upon power-on of a power switch (not shown), and repetitively executes the program until the power switch is turned off. The working memory 96 comprises a RAM, and temporarily stores a plurality of data and flags necessary for executing the program. The data temporarily stored in the working memory 96 include event data indicating that operation states of the keyboard and the operation panel are changed, and performance data input from the recorder 10. The memory 96 has event buffer registers IIVTBUF1 and IIVTBUF2 for temporarily storing these data.

(Description of Operation of Embodiment)

The operation of the embodiment with the above arrangement will be described hereinafter with reference to the flow charts shown in FIGS. 5 to 11.

(1) Description of Operation of Electronic Musical Instrument 60

Figure 15:
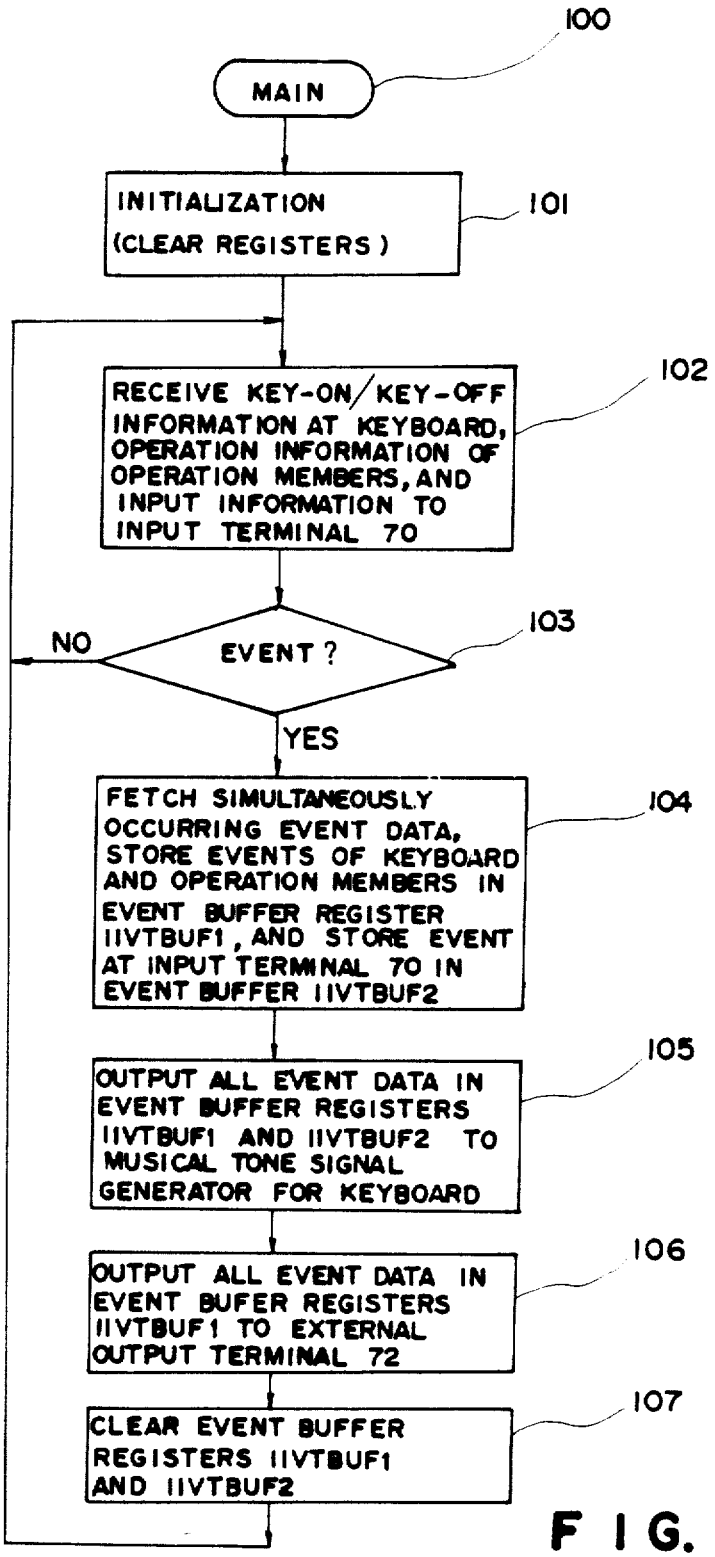
FIG. 15 is a flow chart corresponding to a program executed by a microcomputer of an electronic musical instrument shown in FIG. 2.

When the power switch (not shown) of the electronic musical instrument 60 is turned on, the CPU 94 of the electronic musical instrument 60 starts execution of the main program in step 100 in FIG. 15, and clears the registers in the working memory 96 in step 101, thereby setting the microcomputer 90 in an initial state. Thereafter, the CPU 94 scans the key switches in the key switch circuit 62 and the operation member switches in the operation member switch circuit 64 in step 102. Thus, the CPU 94 fetches key-on/key-off information associated with the keyboard and operation information of the operation members associated with the operation panel through the bus 66, and accesses the buffer circuit 68 to fetch input information from the recorder 10 if it is stored. In step 103, the CPU 94 cooperates with the working memory 96 to detect the presence/absence of a key-on/key-off event at the keyboard, an operation event at the operation panel, and an input event to an input terminal 70 based on the fetched key-on/key-off information, operation information, and input information. If none of the keys at the keyboard is depressed or released, none of the operation members at the operation panel is operated, and no information is input to the input terminal 70, the CPU 94 determines "NO" in step 103, i.e., determines that no event occurs. The flow then returns to step 102, and the CPU 94 continuously executes loop processing consisting of steps 102 and 103.

If one of the keys at the keyboard is depressed or released, one of the operation members at the operation panel is operated, or information is input to the input terminal 70, the CPU 94 determines "YES" in step 103, i.e., determines that an event occurs, and advances the program to key/tone color/effect event processing consisting of steps 104 to 107. In step 104, events detected by the CPU 94 while the CPU 94 executes the loop processing of steps 102 and 103 once are processed as those occurring at the same time. The simultaneously occurring event data are fetched in the event buffer registers IIVTBUF1 and IIVTBUF2 in the working memory 96. In this case, key-on/key-off information associated with the keyboard and operation information of the operation members associated with the operation panel are fetched in the event buffer register IIVTBUF1, and input information from the recorder 10 is fetched in the event buffer register IIVTBUF2. In step 105, all the event data in the event buffer registers IIVTBUF1 and IIVTBUF2 are output to the musical tone generator 80. In this case, if the event data is data representing a key-on event at the keyboard (key-on data), the musical tone signal generator 80 starts formation of a musical tone signal having a key pitch frequency corresponding to the key indicated by the key-on data, and supplies the formed musical tone signal to the loudspeaker 84 through the amplifier 82. As a result, the loudspeaker 84 produces a musical tone having a key pitch frequency corresponding to a key depressed at the keyboard and a key designated by the key-on data in the input information. If the event data is data representing a key-off event at the keyboard (key-off data), the musical tone signal generator 80 stops forming and outputting a musical tone signal associated with a released key and a key designated by the key-off data in the input information. As a result, the loudspeaker stops producing a musical tone associated with the key released at the keyboard and the key designated by the key-off data in the input information.

As described above, if the event data supplied to the musical tone signal generator 80 is associated with the tone color operation members or effect operation members, as described above, the generator 80 controls a tone color of the musical tone signal or an effect to be provided to the signal based on the supplied event data in accordance with the operated operation member and tone color etc. data in the input information. As a result, the tone color of a musical tone to be produced and the effect to be provided thereto are controlled in accordance with an operation of the tone color operation members and effect operation members and the input information.

After step 105, the CPU 94 outputs all the event data stored in the event buffer register IIVTBUF1 to the external output terminal 72 in step 106. Thus, key-on/key-off information associated with the keyboard and operation information of the operation members associated with the operation panel of the electronic musical instrument are output to the recorder 10 as performance data.

In step 107, the CPU 94 clears all the event data in the event buffer registers IIVTBUF1 and IIVTBUF2, and the flow then returns to step 102. The CPU 94 executes the loop processing consisting of steps 102 and 103 again. During the loop processing, if a key-on/key-off event at the keyboard, an operation of the tone color operation members and effect operation members, or performance data input from the recorder 10 is detected, the CPU 94 controls generation of a musical tone in accordance with the key-on/key-off event, the operation, or the input information in steps 104 to 107, as described above.

(2) Description of Operation of Recorder 10

2-1. Main Processing

Figure 5:
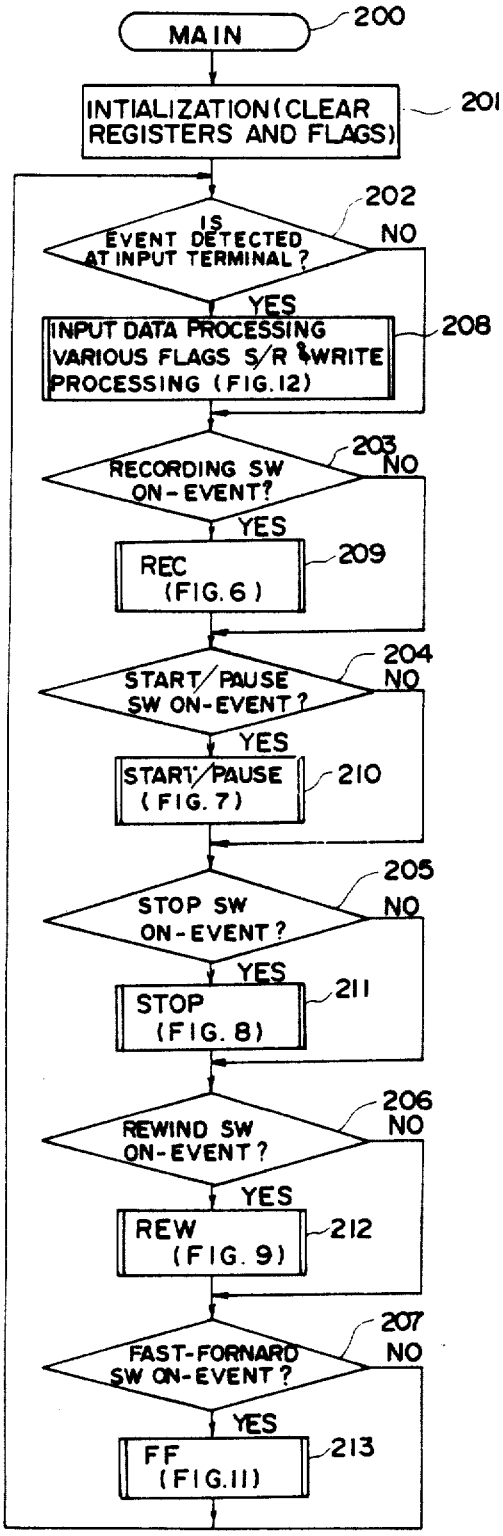
FIGS. 5 to 14 are flow charts corresponding to programs executed by a microcomputer of the recorder shown in FIG. 2.

When the power switch 46 (FIG. 3) of the recorder 10 is turned on, the CPU 18 of the recorder 10 starts executing the main program in step 200 in FIG. 5, and clears the registers and flags in the working memory 20 in step 201, thus setting the microcomputer 12 in an initial state. Thereafter, the CPU 18 accesses the buffer circuit 28 in step 202 to detect the presence/absence of an event at the input terminal 50. In steps 203 to 207, the CPU 18 scans the recording switch 36, the start/pause switch 38, the stop switch 44, the rewind switch 42, and the fast-forward switch 40 to detect the presence/absence of events at these switches. If no information is input at the input terminal 50 and none of the switches 38 to 44 is operated, the CPU 18 obtains "NO" in steps 202 to 207, i.e., determines that no event occurs, and continuously executes loop processing consisting of steps 202 to 207.

2-2 Recording Switch Processing

When the recording switch 36 is operated in the loop processing consisting of steps 202 to 207 in FIG. 5, the CPU 18 obtains "YES" in step 203, i.e., determines that an event occurs, and the flow advances to step 209. In step 209, the CPU 18 executes recording switch processing shown in detail in FIG. 6.

In the recording switch processing, the CPU 18 starts execution of the processing in step 300, and checks in steps 301 to 303 if the in-play flag PLY, in-recording flag REC, and play pause flag PLYPSE set in the working memory 20 are "1".

If "NO" in steps 301 and 302, that is, if it is determined that both the in-play flag PLY and in-recording flag REC are "0", the CPU 18 executes step 303. If the play pause flag PLYPSE is "1", the CPU 18 resets the flag PLYPSE in step 304. If the play pause flag PLYPSE is "0", the flow skips step 304 to step 305 while the flag PLYPSE is kept in a reset state ("0"). The CPU 18 sets the recording pause flag RECPSE in step 305, and ends the recording switch processing in step 306. The flow then returns to step 204 in FIG. 5. More specifically, if the recording switch 36 is operated in an operation mode other than the in-play and in-recording modes (and fast-forward and rewind modes), the operation mode of the recorder 10 is set in the recording synchronous start state. In the recording synchronous start state, the recorder 10 is temporarily stopped in the recording standby state, and starts the recording operation in synchronism with a key-on event at the electronic musical instrument 60.

If it is determined in step 301 that the in-play flag PLY is "1", the flow advances to step 307, and the CPU 18 sets the running recording flag RUNREC. In step 306, the CPU ends the recording switch processing, and the flow returns to step 204 in FIG. 5. That is, if the recording switch 36 is operated during the playback operation, the operation mode of the recorder 10 is set in the running recording mode. In the running recording mode, a recording operation is reserved while continuing a playback operation, and the operation mode is switched to the recording state in synchronism with a key-on event at the keyboard of the electronic musical instrument 60.

If it is determined in steps 301 and 302 that the in-play flag PLY is "0" and the in-recording flag REC is "1", the CPU 18 writes the previous tempo count value TCNT(PR) and the previous address value ADR(PR) in the tempo counter TCNT and the address pointer ADR, and resets the in-recording flag REC in step 308. In step 305, the CPU 18 sets the recording pause flag RECPSE in step 305, and ends the recording switch processing in step 306. Thereafter, the flow returns to step 204 in FIG. 5. More specifically, when the recording switch 36 is operated during the recording operation, the operation mode of the recorder 10 is set in the re-recording mode. In the re-recording mode, a re-recording operation is executed from a recording position at the beginning of the immediately preceding recording operation before the recording switch 36 is operated. After the tempo count TCNT and the address ADR are set to be the recording position, the recording synchronous start state is set, and the recording operation can be re-started in synchronism with a key-on event at the keyboard of the electronic musical instrument 60.

2-3. Start/Pause Switch Processing

When the start/pause switch 38 is operated during the loop processing consisting of steps 202 to 207 in FIG. 5, the CPU 18 obtains "YES" in step 204, that is, determines that an event occurs, and the flow advances to step 210. In step 210, the CPU 18 executes start/pause switch processing shown in detail in FIG. 7.

Figure 7:
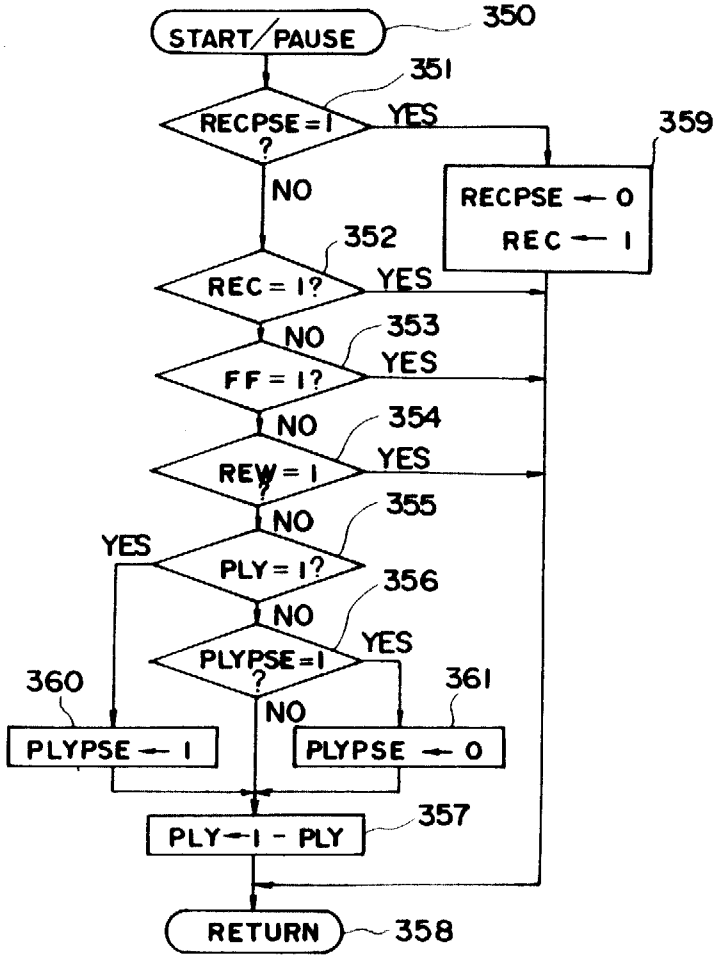

In the start/pause switch processing in FIG. 7, the CPU 18 starts execution of the processing in step 350, and checks in steps 351 to 356 if the recording pause flag RECPSE, the in-recording flag REC, the fast-forward flag FF, the rewind flag REW, the in-play flag PLY, and the play pause flag PLYPSE set in the working memory 20 are "1".

If "NO" in steps 351 to 355, that is, if it is determined that the recording pause flag RECPSE, the in-recording flag REC, the fast-forward flag FF, the rewind flag REW, and the in-play flag PLY are "0", the CPU 18 executes step 356. If the play pause flag PLYPSE is "1", the CPU 18 resets the flag PLYPSE in step 361, and the flow advances to step 357. On the other hand, if the play pause flag PLYPSE is "0", the flow directly advances to step 357 while the flag PLYPSE is kept reset ("0"). The CPU 18 inverts (i.e., resets) the play flag PLY in step 357, and ends the start/pause switch processing in step 358. The flow then returns to step 205 in FIG. 5. More specifically, when the start/pause switch 38 is operated in the play synchronous start state or in the stop state, the operation mode of the recorder 10 is switched to the playback mode.

If it is determined in step 351 that the recording pause flag RECPSE is "1", the flow advances to step 359 to reset the recording pause flag RECPSE and to set the in-recording flag REC. Thereafter, in step 358, the CPU 18 ends the start/pause switch processing, and the flow returns to step 205 in FIG. 5. More specifically, when the start/pause switch 38 is operated in the recording synchronous start state, the operation mode of the recorder 10 is set in the recording mode.

If it is determined in one of steps 352 to 354 that one of the in-recording flag REC, the fast-forward flag FF, and the rewind flag REW is "1", the flow directly advances from the corresponding step to step 358, and the start/pause switch processing is ended. The flow then returns to step 205 in FIG. 5. More specifically, when the start/pause switch 38 is operated during the recording, fast-forward, or rewind operation, the operation is neglected in this start/pause switch processing.

If it is determined in step 355 that the in-play flag PLY is "1", the CPU 18 sets the play pause flag PLYPSE in step 360, and inverts (i.e., resets) the in-play flag PLY in step 357. Thereafter, the start/pause switch processing is ended in step 358, and the flow returns to step 205 in FIG. 5. More specifically, when the start/pause switch 38 is operated during the playback operation, the operation mode of the recorder 10 is set in the play synchronous start mode. In the play synchronous start mode, when the keyboard of the electronic musical instrument 60 is operated to generate a key-on signal, the playback operation (automatic performance) is started in synchronism with the keyboard operation.

2-4. Stop Switch Processing

When the stop switch 44 is operated during the loop processing consisting of steps 202 to 207 in FIG. 5, the CPU 18 obtains "YES" in step 205, that is, determines that an event occurs, and the flow advances to step 211. In step 211, the CPU 18 executes stop switch processing shown in detail in FIG. 8.

Figure 8:
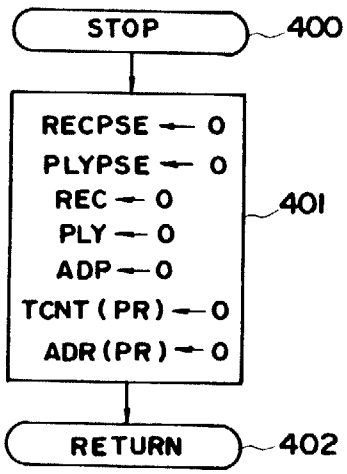

In the stop switch processing in FIG. 8, the CPU 18 starts execution of the processing in step 400. In step 401, the CPU 18 resets the recording pause flag RECPSE, the play pause flag PLYPSE, the in-recording flag REC, and the in-play flag PLY set in the working memory 20, and clears the address ADR, the previous tempo counter register TCNT(PR), and the previous address register ADR(PR). In step 402, the CPU ends the stop switch processing in step 402, and the flow returns to step 206 in FIG. 5. More specifically, when the stop switch 44 is operated in a mode other than the fast-forward and the rewind modes, the operation mode of the recorder 10 is set in the stop mode. Note that in the fast-forward and rewind modes, the operation of the stop switch 44 is neglected, as will be described later.

2-5. Rewind Switch Processing

When the rewind switch 42 is operated during the loop processing consisting of steps 202 to 207 in FIG. 5, the CPU 18 obtains "YES" in step 206, that is, determines that an event occurs, and the flow advances to step 212. In step 212, the CPU 18 executes rewind switch processing shown in detail in FIG. 9.

Figure 9:
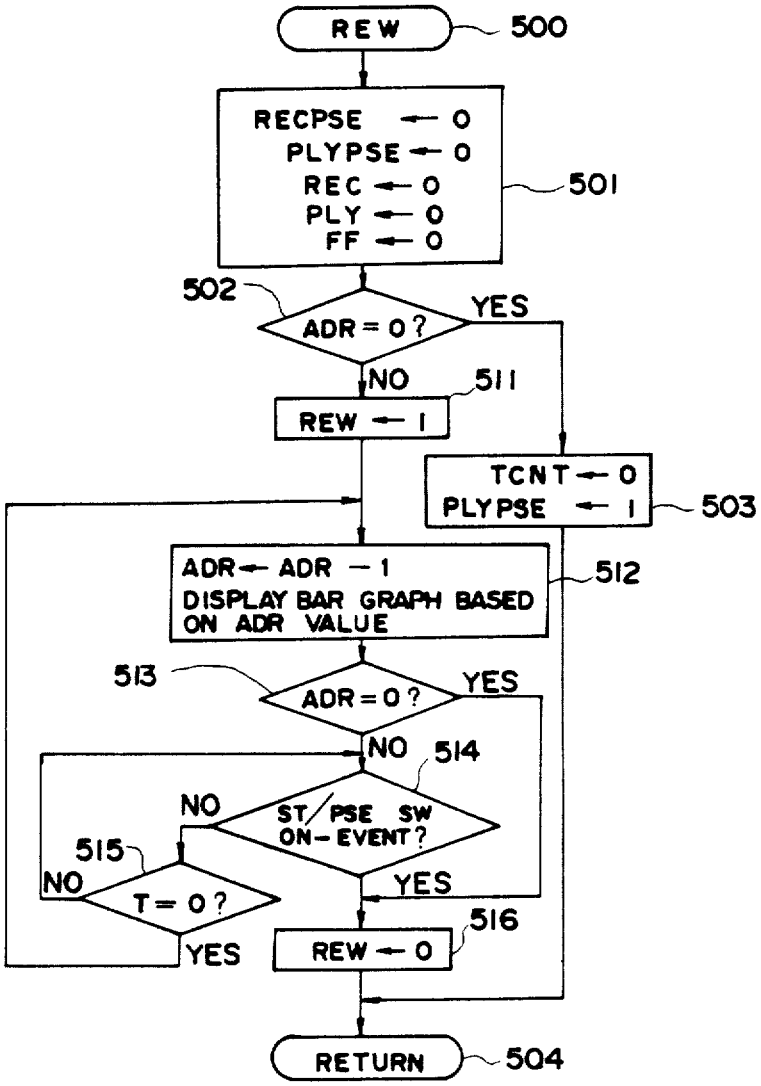

In the rewind switch processing in FIG. 9, the CPU 18 starts execution of the processing in step 500, and resets the recording pause flag RECPSE, the play pause flag PLYPSE, the in-recording flag REC, the in-play flag PLY, and the fast-forward flag FF set in the working memory 20. Thereafter, the CPU 18 checks in step 502 if the address value ADR is "0". If YES in step 502, since the address value ADR="0" indicates the start position of the performance data memory 34 and the current address is the start address, the CPU 18 clears the tempo count value TCNT and sets the play pause flag PLYPSE in step 503. In step 504, the CPU 18 ends the rewind switch processing, and the flow returns to step 207 in FIG. 5. More specifically, when the rewind switch 42 is operated in a state wherein the address value ADR is "0", the operation mode of the recorder 10 is not set in the rewind mode but in the play synchronous start state.

If "NO" in step 502, that is, it is determined that the address value ADR is not "0", the flow advances to step 511 to set the rewind flag REW. In step 512, the CPU 18 decrements the address value ADR by "1", and causes the display 48 (FIG. 3) of the panel portion to display a bar graph of a performance data recording amount (or a memory remaining amount) based on the new address value ADR. The CPU 18 then checks in step 513 if the address value ADR is "0". If "NO" in step 513, that is, it is determined that the value ADR is not "0", the CPU 18 checks in step 514 if the start/pause switch 38 is operated. If NO in step 514, the CPU 18 checks a timer value T in step 515. The CPU 18 executes idling processing for repeating processing in steps 514 and 515 until the timer value T becomes "0" or the switch 38 is operated. If it is determined in step 515 that the timer value T becomes "0", the flow returns to step 512, and the CPU 18 decrements the address value ADR.

Figure 10:
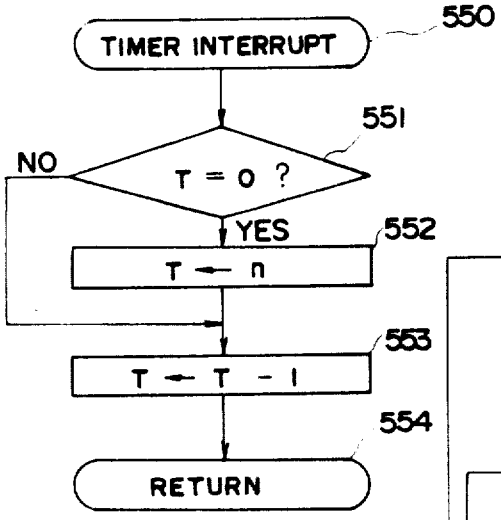

The timer value T is decremented from a predetermined value n by timer interrupt processing in FIG. 10 every time the interrupt signal TIMEIRT is output from the timer oscillator 30, and becomes "0" every n interrupt signals TIMEIRT. More specifically, the address value ADR is decremented in a period n times the period of the interrupt signal TIMEIRT.

When the address value ADR becomes "0", "YES" is obtained in step 513 in FIG. 9, and the flow advances to step 516. The CPU 18 resets the rewind flag REW in step 516, and ends the rewind switch processing in step 504. The flow then returns to step 207 in FIG. 5. More specifically, when the address value ADR becomes "0" in the rewind operation, the operation mode of the recorder 10 is set in the stop mode.

When the start/pause switch 38 is operated during the rewind operation, "YES" is obtained in step 514, and the flow advances to step 516. The CPU 18 resets the rewind flag REW in step 516, and ends the rewind switch processing in step 504. The flow then returns to step 207 in FIG. 5. That is, when the start/pause switch 38 is operated during the rewind operation, the operation mode of the recorder 10 is set in the stop mode. During the rewind operation, the operations of the switches other than the start/pause switch 38, i.e., switches 36 and 46 to 48, are neglected.

2-6. Fast-forward Switch Processing

When the fast-forward switch 40 is operated during the loop processing consisting of steps 202 to 207 in FIG. 5, the CPU 18 obtains "YES" in step 207, that is, determines that an event occurs, and the flow advances to step 213. In step 213, the CPU 18 executes fast-forward switch processing shown in detail in FIG. 11.

Figure 11:
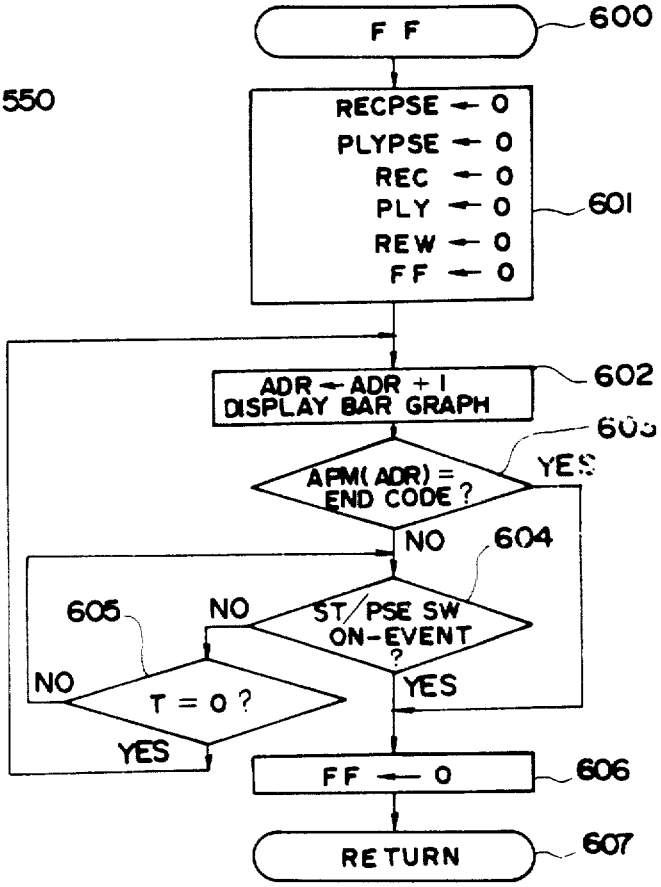

In the fast-forward switch processing in FIG. 11, the CPU 18 starts execution of the processing in step 600, and resets the recording pause flag RECPSE, the play pause flag PLYPSE, the in-recording flag REC, the in-play flag PLY, and the rewind flag REW set in the working memory 20 in step 601. In step 602, the CPU 18 increments the address value ADR by "1", and causes the display 48 (FIG. 3) of the panel portion to display a bar graph of a performance data recording amount (and memory remaining amount) based on the new address value ADR. Thereafter, the CPU 18 checks in step 603 if data stored at the storage position APM(ADR) of the performance data memory 34 is an end code. If NO in step 603, the CPU 18 checks in step 604 if the start/pause switch 38 is operated. If NO in step 604, the CPU 18 checks the timer value T in step 605. The CPU 18 executes idling processing for repeating processing in steps 604 and 605 until the timer value T becomes "0" or the switch 38 is operated. If it is determined in step 605 that the timer value T becomes "0", the flow returns to step 602, and the CPU 18 increments the address value ADR. The timer value T is decremented by the timer interrupt processing in FIG. 10 in the same manner as in the rewind processing described above. Therefore, the increment cycle of the address value ADR in this fast-forward switch processing is also n times the period of the interrupt signal TIMEIRT.

When the address value ADR is incremented and the end code is detected at the storage position APM(ADR), since no performance data is stored at the following storage positions, the fast-forward operation is of no significance. In this case, "YES" is obtained in step 603, and the flow advances to step 606. The CPU 18 resets the fast-forward flag FF in step 606, and ends the fast-forward switch processing in step 607. The flow then returns to step 202 in FIG. 5. When the start/pause switch 38 is operated during the fast-forward operation, "YES" is obtained in step 604, and the flow advances to step 606. The CPU 18 resets the fast-forward flag FF in step 606, and ends the fast-forward switch processing in step 604. The flow then returns to step 207 in FIG. 5. That is, when the end code is read out during the fast-forward operation or the start/pause switch 38 is operated, the operation mode of the recorder 10 is set in the stop mode. During the fast-forward operation, the operations of the switches other than the start/pause switch 38, i.e., the switches 36 and 46 to 48 are neglected.

2-7. Input Data Processing

When performance data is input to the input terminal 50 of the recorder 10 in the loop processing consisting of steps 202 to 207 in FIG. 5 since the electronic musical instrument 60 executes the processing in step 106 in FIG. 15, the CPU 18 obtains "YES" in step 202, i.e., determines that an event occurs. The flow advances to step 208, and the CPU 18 executes input data processing shown in detail in FIG. 12.

Figure 12:
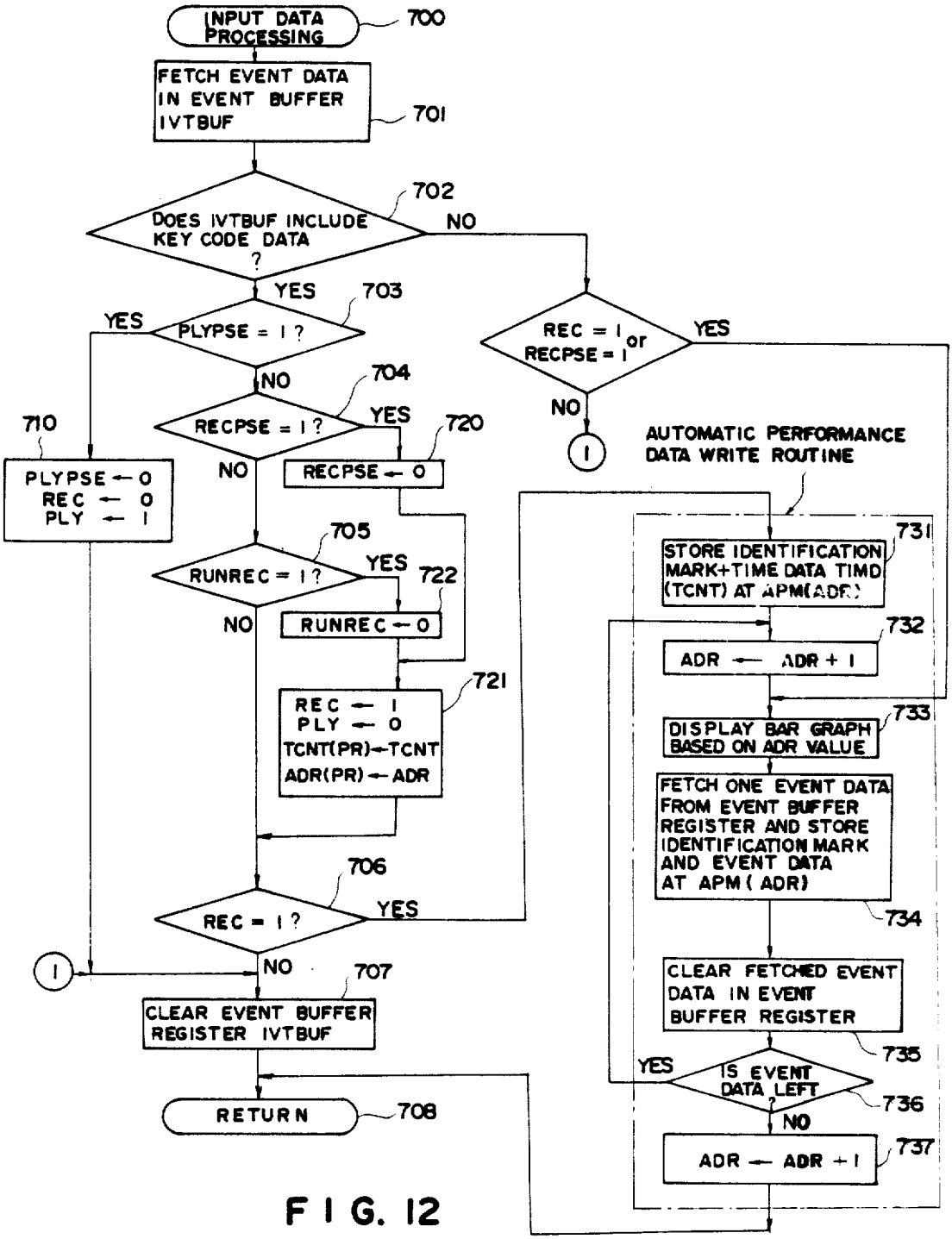

In the input data processing in FIG. 12, the CPU 18 starts execution of the processing in step 700, and fetches all the event data in the buffer circuit 28 in the event buffer IVTBUF in step 701. The CPU 18 checks in step 702 if the event data in the event buffer IVTBUF includes key code data. If "YES" is obtained in step 702, that is, it is determined that the key code data is stored in the event buffer IVTBUF, the flow advances to step 703, and the CPU 18 checks in steps 703 to 706 if the play pause flag PLYPSE, the recording pause flag RECPSE, the running recording flag RUNREC, and the in-recording flag REC set in the working memory 20 are "1".

If "NO" in steps 703 to 706, that is, the recorder 10 is in the stop mode or in the playback mode, the CPU 18 clears the event buffer IVTBUF in step 707, and ends the input data processing in step 708. The flow returns to step 203 in FIG. 5. In this case, the performance data input from the electronic musical instrument 60 to the input terminal 50 is neglected.

If it is determined in step 703 that the play pause flag PLYPSE is "1", that is, the recorder 10 is in the play synchronous start state, the flow advances to step 710, and the CPU 18 resets the play pause flag PLYPSE and the in-recording flag REC, and sets the in-play flag PLY. Thereafter, the CPU 18 clears the event buffer IVTBUF in step 707, and ends the execution of the input data processing in step 708. The flow then returns to step 203 in FIG. 5. More specifically, in the play synchronous start state, the playback operation (automatic performance) is started in synchronism with a key-on event.

If it is determined in step 704 that the recording pause flag RECPSE is "1", that is, the recorder 10 is in the recording synchronous start state, the flow advances to step 720, and the CPU 18 resets the recording pause flag RECPSE. In step 721, the CPU 18 sets the in-recording flag REC, resets the in-play flag PLY, and stores the present tempo count value TCNT and address value ADR in the previous tempo counter register TCNT(PR) and the previous address register ADR(PR). Thereafter, the CPU 18 checks in step 706 if the in-recording flag REC is "1". Since the in-recording flag REC is already set in step 721, "YES" is obtained in step 706, and the flow advances to step 731. The CPU 18 then executes an automatic performance data write routine in steps 731 to 737. More specifically, in the recording synchronous start state, the recording operation (write access) is started in synchronism with a key-on event. For this reason, no blank portion after the recording mode is set until the keyboard is played is not formed, and a no-tone state is not established. Therefore, the player can be prevented from feeling uneasy, and the memory can be prevented from being wasted by the blank portion. Note that when a music piece starting with an up beat, which is quietly started after a rest is played at the beginning of the music piece, is input, the recording switch 36 is operated to set the recording synchronous starting mode, and the start/pause switch 38 is then operated to select the recording mode, and a performance can be started (keyed on) after a period corresponding to the rest passes.

In the performance data write routine, timing data is stored as performance data at the storage position APM(ADR) of the performance data memory 34 in step 731. The timing data consists of the identification mark and time data TIMD, as shown in FIG. 4. The identification mark is set to be a code indicating that the performance data is timing data, and the time data is set to be a value indicated by the tempo count TCNT. Thus, the time data TIMD indicates a timing corresponding to a time from the bar line of a measure.

After step 731, the CPU 18 increments the address ADR (ADR=ADR+1) in step 732, and causes the display 48 of the panel portion (FIG. 3) to display the bar graph of the performance data recording amount based on the new address value ADR in step 733. In step 734, the CPU 18 fetches one of event data stored in the event buffer register IVTBUF in the processing of step 701, adds an identification mark to the fetched event data to form performance data, and stores the performance data at the storage position APM(ADR) of the performance data memory 34. Furthermore, the CPU 18 clears the event data fetched in step 734 from the event buffer register in step 735, and checks in step 736 if the event data is left in the event buffer register. In this case, if the event data is left, "YES" is obtained in step 736, and the flow returns to step 732. The CPU 18 then executes the write processing of the next event data. On the other hand, if there is no event data in the event buffer register, the CPU 18 determines "NO" in step 736, and the flow advances to step 737. Furthermore, the CPU 18 increments the address ADR in step 737, and ends execution of the input data processing in step 708. The flow then returns to step 203 in FIG. 5.

If it is determined in step 705 that the running recording flag RUNREC is "1", that is, the recorder 10 is set in the running recording mode, the flow advances to step 721, and the CPU 18 resets the running recording flag RUNREC. After the CPU 18 executes the processing in steps 721 and 706, it executes the automatic performance data write routine in steps 731 to 737. More specifically, in the running recording mode, the playback operation is executed, and the operation mode is continuously shifted from the playback state to the recording state in synchronism with the key-on event. For this reason, in this mode, the recording operation can be restarted upon key-on at an arbitrary timing during the playback operation, and performance data can be easily corrected or added. For example, if data is partially erroneously input, the correct portion is played back, and the performance is started (keyed on) immediately before a wrong portion. Thus, the data can be very smoothly edited in real time without shifting a timing.

Figure 6:
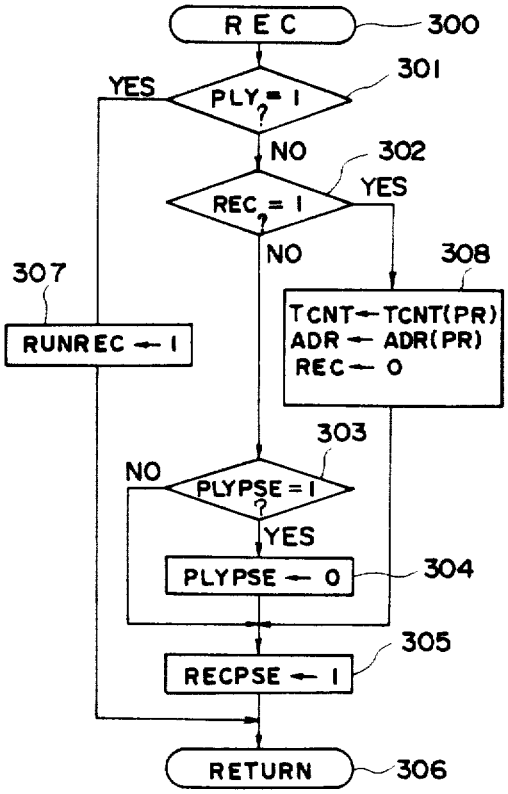

In the recorder 10, in step 721, the tempo count value TCNT and the address value ADR when a key-on event occurs in the recording synchronous start mode or running recording mode are stored. When the recording switch 36 is operated in the recording mode set by the above key-on event, the stored values are set in the tempo counter TCNT and the address pointer ADR in step 308 (FIG. 6). More specifically, when the recording switch 36 is operated during recording, a re-recording state wherein the next recording operation can be synchronously started while the timing TCNT and the recording position ADR are set to be those when the immediately preceding recording operation is started, can be realized. Thus, real-time editing of performance data can be tried "in small pieces" until it can be perfectly edited. The "small piece" section can be arbitrarily set at an error point or a proper point immediately before the error point. When an edit operation is unnecessary, the stop switch 44 is operated to interrupt the re-recording state and to set the stop state.

If the in-recording flag REC is already set in step 721 or 359 (FIG. 7), i.e., during the recording operation, "NO" is obtained in steps 703 to 705, and "YES" is obtained in step 706. Therefore, in this case, if event data including key code data is input from the electronic musical instrument from the input terminal 50, the event data and generation timing TIMD of the event data are recorded in the performance data memory 34 in the automatic performance data write routine consisting of steps 731 to 737.

If it is determined in step 701 that the event data fetched in the event buffer IVTBUF do not include key code data, i.e., that the event data consist of only tone color etc data and measure data, "NO" is obtained in step 702, and the flow advances to step 740. In step 740, the CPU 18 checks the in-recording flag REC and the recording pause flag RECPSE. If both the in-recording flag REC and the recording pause flag RECPSE are "0", the flow advances to step 707, and the CPU 18 clears the event buffer IVTBUF In step 708, the CPU 18 ends the execution of the input data processing, and the flow then returns to step 203 in FIG. 5.

If "YES" in step 740, i.e., if one of the in-recording flag REC and the recording pause flag RECPSE is "1", the flow advances to step 733, and the CPU 18 executes the processing in steps 733 to 737 and 732 described above. Thus, when event data including no key code data is input to the input terminal 50, only the event data is recorded in the performance data memory 34 without timing data. Therefore, automatic performance data based on changing or setting operation of tone color and the like can be recorded without advancing a timing even in the recording synchronous start state.

2-8. Tempo Interrupt Processing

Figure 13:
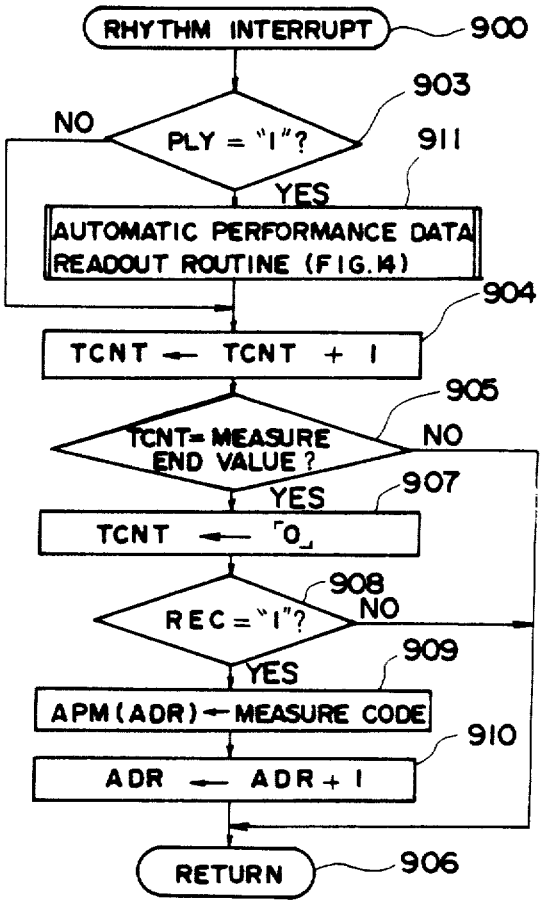

When the tempo clock signal TMPINT is generated from the tempo oscillator 28 during execution of the main processing in FIG. 5 or its subroutine processing (FIGS. 6 to 12), the CPU 18 interrupts the execution of the corresponding program, and starts execution of the tempo interrupt program from step 900 in FIG. 13. The CPU 18 checks in step 903 if the in-play flag PLY is "1". In this case, if the in-play flag PLY is set to be "0", i.e., the recorder 10 is set in a mode other than the playback mode, "NO" is obtained in step 903, and the flow advances to step 904. The CPU 18 executes an arithmetic operation TCNT=TCNT+1 to increment the tempo count TCNT by "1" in step 904, and checks in step 905 if the incremented tempo count TCNT indicates an end value of a measure. If NO in step 905, "NO" is obtained in step 905, and the flow advances to step 906, thus ending the tempo interrupt processing.

If it is determined in step 904 that the incremented tempo count TCNT indicates the end value of the measure, the CPU 18 determines "YES" in step 905 based on the tempo count TCNT, and initializes the tempo count TCNT to "0" in step 907. The flow then advances to step 908. The CPU 18 checks in step 908 if the in-recording flag REC is "1". In this case, if the recorder 10 is set in a mode other than the recording mode, since the flag REC is "0", the CPU 18 determines "NO" in step 908, and ends the execution of the tempo interrupt processing in step 906. If "YES" in step 908, i.e., if the recorder 10 is set in the recording mode and the in-recording flag REC is "1", the flow advances to step 909, and the CPU 18 writes a measure code (FIG. 4) consisting of identification data representing timing data and (measure end value - 1) as a value before increment in step 904. The CPU 18 executes an arithmetic operation ADR=ADR+1 to increment the address ADR by "1" in step 910, and ends the execution of the tempo interrupt program in step 906.

2-9. Automatic Performance Data Readout Routine Processing

As described above, when the start/pause switch 38 is operated in the stop state or in the play synchronous start state during loop processing consisting of steps 202 to 207 (FIG. 5) and when the keyboard performance of the electronic musical instrument 60 is started (keyed on), the recorder 10 is set in the playback mode.

In this state, when the tempo clock signal is generated from the tempo oscillator 30, the tempo interrupt processing is executed, and the tempo count TCNT is incremented in the processing of steps 900 to 908.

Figure 14:
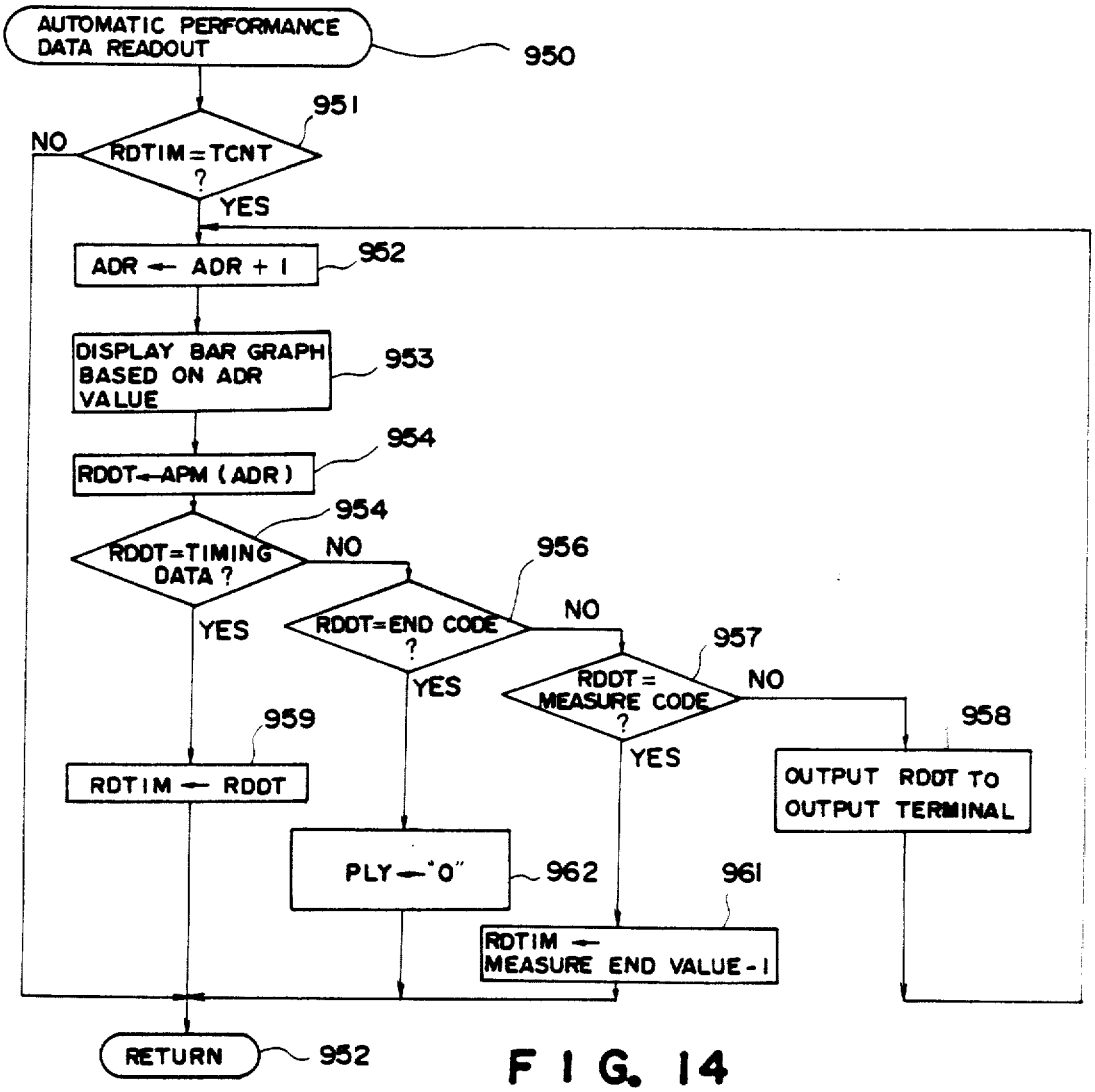

In this case, if the in-play flag PLY is set to be "1", the CPU 18 determines "YES" in step 903 during execution of the tempo interrupt processing, and executes in step 911 an automatic performance data readout routine shown in detail in FIG. 14.

The automatic performance data readout routine is started from step 950, and the CPU 18 first checks in step 951 if read timing data RDTIM is equal to the tempo count TCNT. If the read timing data RDTIM is not equal to the present tempo count TCNT, "NO" is determined in step 951, and the automatic performance data readout routine is ended in step 952. On the other hand, if the tempo count TCNT is increased and the read timing data RDTIM becomes equal to the tempo count TCNT, the CPU 18 determines "YES" in step 951, and increments the address ADR by "1" in step 952. In step 953, the CPU 18 causes the display 48 of the panel portion (FIG. 3) to display the bar graph of an automatic performance position based on the incremented address ADR. In step 954, the CPU 18 reads out performance data stored at the storage position APM-(ADR) of the performance data memory, and sets the readout performance data as read data RDDT.

The CPU 18 then checks in steps 955, 956 and 957 if the read data RDDT is one of timing data, end code, measure code, and other data (key-on or key-off data or tone color etc. data). If the read data RDDT is other data (key-on or key-off data or tone color etc. data), "NO" is obtained in steps 955, 956, and 957, and the read data is output to the output terminal 52 in step 958. In the electronic musical instrument 60, the read data RDDT is input to the input terminal 70 through the data bus 56, and is detected as an input information event in the processing of steps 102 and 103 (FIG. 15). The read data RDDT is output to the musical tone signal generator 80 through the bus 66 in the processing of step 106. The musical tone signal generator 80 controls formation of a musical tone signal based on the supplied key-on or key-off data or tone color etc. data, and outputs the formed musical tone signal to the loudspeaker 84 through the amplifier 82. Thus, the loudspeaker 84 produces a musical tone corresponding to the musical tone signal Thus, an automatic performance tone can be produced from the loudspeaker 84 based on the performance data stored in the performance data memory 34 of the recorder 10.

In the recorder 10, after step 958, the flow returns to step 952 to increment the address ADR by "1". In step 953, the bar graph is displayed. Thereafter, performance data stored at the storage position APM(ADR) in the performance data memory 34 designated by the incremented address ADR is set as new read data RDDT, and the type of this read data RDDT is discriminated by the processing in steps 955 to 957. In this case, if the read data RDDT is key-on or key-off data or tone color etc. data again, generation of a musical tone is controlled by the processing in step 958. In this manner, all the key-on and key-off data and tone color etc. data stored at the same timing are read out from the performance data memory 34, and generation of the automatic performance tone can be controlled.

In the loop processing consisting of steps 954 to 958, if the read data RDDT set in step 954 is timing data, the CPU 18 determines "YES" in step 955, and sets the read data RDDT as read timing data RDTIM in step 959, thus ending the execution of the automatic performance data readout routine in step 952. If the read data RDDT set in step 954 is a measure code, the CPU 18 determines "YES" in step 957, and sets a value obtained by subtracting "1" from a measure end value in step 905 (FIG. 13) as data RDTIM in step 961. In step 952, the automatic performance data readout routine is ended. Thereafter, every time the tempo interrupt processing is executed, processing consisting of steps 950 to 952 is executed When the set read timing data RDTIM becomes equal to the tempo count TCNT, the CPU 18 executes the above processing consisting of steps 954 to 958, and controls generation of the automatic performance tones.

If the read data RDDT set in step 954 is an end code, the CPU 18 determines "NO" in step 955, and determines "YES" in step 956. In step 962, the CPU 18 sets the in-play flag PLY to be "0" to cancel the automatic performance playback mode, and ends the execution of the automatic performance data readout routine in step 952.

The present invention is not limited to the above embodiment, and various changes and modifications may be made within the spirit and scope of the invention. For example, in the above description, performance data output from the electronic musical instrument 60 does not include time base data such as a timing, and the recorder 10 measures an input timing of the performance data and adds the time base data. However, the performance data output from the electronic musical instrument 60 may include the timing data, and the recorder 10 may simply record the input performance data.

In the above embodiment, a recording operation of an end code is not specified. However, the end code can be recorded by a method employed in a known apparatus.

In the above embodiment, the tempo count TCNT is reset every bar line of the measure but may be reset upon input or read access of event data. More specifically, in the above embodiment, the tempo count value TCNT indicates a timing in a measure but may indicate a time interval between adjacent events. In the latter case, when performance data is read out, time data corresponding to an event is fetched in a timer register, and the value of the register can be decremented by one every tempo pulse.

What is claimed is:

1. An automatic performance apparatus, comprising:

a performance data memory means for storing performance data for controlling generation of musical tones along with the progression of a music piece;

a performance data recording means for recording in said performance data memory the performance data sequentially generated along with the progression of the music piece;

a specific recording mode selection means for selecting a specific recording mode; and an operation mode control means for, when the specific recording mode is selected by said mode selection means, setting an operation mode of said performance data recording means to a recording preparation mode and for, when first key-on data indicating generation of a musical tone to be recorded is generated, switching and setting the operation mode to a recording mode.

2. An automatic performance apparatus, comprising:

a performance data memory means for storing performance data for controlling generation of musical tones along with the progression of a music piece;

a performance data recording means for recording in said performance data memory the performance data sequentially generated along with the progression of the music piece;

a specific recording mode selection means for selecting a synchronous recording mode; and an operation mode control means for, when the specific recording mode is selected by said mode selection means, setting an operation mode of said performance data recording means to a recording standby mode representing an operation stop state and for, when first key-on data indicating generation of a musical tone to be recorded is generated, switching and setting the operation mode to the recording mode.

3. An automatic performance apparatus, comprising:

a performance data memory means for storing performance data for controlling generation of musical tones along with the progression of a music piece;

a performance data recording means for recording in said performance data memory the performance data sequentially generated along with the progression of the music piece;

a specific recording mode selection means for selecting a re-recording mode in which previously recorded performance data can be replaced by new performance data; and an operation mode control means for, when the re-recording mode is selected by said mode selection means, setting an operation mode of said performance data recording means to, a recording standby mode wherein said performance data memory means is set at the beginning position of a previously recorded section of said music piece and a recording mode is suspended in an operation stop state and for, when first key-on data indicating generation of a musical tone to be recorded is generated, switching and setting the operation mode to the recording mode.

4. An automatic performance apparatus, comprising:

a performance data memory means for storing performance data for controlling generation of musical tones along with the progression of a music piece;

a performance data recording means for recording in said performance data memory the performance data sequentially generated along with the progression of the music piece;

a specific recording mode selection means for selecting a running recording mode in which previously recorded performance data is played back and new performance data can be recorded in a desired relationship with respect to the previously recorded performance data; and an operation mode control means for, when the running recording mode is selected by said mode selection means, setting an operation mode of said performance data recording means to a recording reservation mode wherein a playback state is maintained and for, when first key-on data indicating generation of a musical tone to be recorded is generated, switching and setting the operation mode to the recording mode.

* * * * *